United States Patent [19]

Kushigian

[11] 4,202,317

[45] May 13, 1980

[54] GRINDING WHEEL DRESSER

[76] Inventor: Anthony Kushigian, P.O. Box 768, Hendersonville, N.C. 28739

[21] Appl. No.: 892,208

[22] Filed: Mar. 31, 1978

[51] Int. Cl.[2] ..... B24B 53/02

[52] U.S. Cl. ..... 125/11 H; 125/11 ST

[58] Field of Search ..... 125/11 R, 11 AS, 11 ST, 125/11 A, 11 H, 11 BS

[56] References Cited

U.S. PATENT DOCUMENTS

| | | | |
|---|---|---|---|
| 2,366,623 | 2/1945 | Jakobsen | 125/11 AS |
| 2,400,825 | 5/1946 | Jakobsen | 125/11 R |
| 2,475,210 | 7/1949 | Turrettini | 125/11 ST |
| 3,075,513 | 1/1963 | Seidel | 125/11 A |
| 3,093,128 | 6/1963 | Seidel | 125/11 A |
| 3,669,089 | 6/1972 | Swenson | 125/11 R |
| 3,827,420 | 8/1974 | Hoglund | 125/11 BS |

FOREIGN PATENT DOCUMENTS

| | | | |
|---|---|---|---|
| 389762 | 3/1933 | United Kingdom | 125/11 ST |
| 1362691 | 8/1974 | United Kingdom | 125/11 A |

*Primary Examiner*—Harold D. Whitehead
*Assistant Examiner*—K. Bradford Adolphson
*Attorney, Agent, or Firm*—Barnes, Kisselle, Raisch & Choate

[57] ABSTRACT

A grinding wheel dresser with a diamond-tipped dressing tool carried by a pivotally mounted arm driven by a fluid-actuated drive to sweep the diamond tip across the working surface of a grinding wheel. The arm and fluid-actuated drive are carried by an arbor mounted for rotation in a housing and having a knob secured thereto so that the arbor can be manually rotated to angularly orient the path of the diamond tip with respect to the working face of the grinding wheel to permit the dressing of work surfaces with differing contours and inclinations to the axis of rotation of the wheel.

5 Claims, 5 Drawing Figures

GRINDING WHEEL DRESSER

BACKGROUND OF THE INVENTION

This invention relates to apparatus for grinding workpieces and, more particularly, to grinding wheel dressers.

To provide the proper cutting action when grinding a workpiece, it is desirable to have sharp abrasive grains of the grinding wheel working surface exposed at all times. However, as a grinding wheel is used to remove metal from a workpiece, the exposed abrasive grains of the working surface become dull and particles of metal and contaminants become lodged between the grains. Hence, unused sharp grains of the wheel are exposed, and dull grains and particles of metal and contaminants are removed by periodically dressing the grinding wheel. One way of dressing the wheel is by passing a diamond or other hard cutting tool across the working face of the rotating wheel to cut away or remove the dull grains and the particles of metal contaminants lodged between the dull grains.

A grinding wheel dresser embodying this invention has a diamond dressing tool carried by a pivotally mounted arm driven by a fluid-actuated drive to sweep the diamond dressing tool in a path across the working surface of a rotating grinding wheel. The arm and fluid-actuated drive are carried by an arbor received in a mounting body so that the angular orientation of the path of the diamond dressing tool can be varied and adjusted with respect to the working surface of the grinding wheel to facilitate the dressing of various working surfaces with different contours and/or inclinations with respect to the axis of rotation of the grinding wheel.

Objects, features and advantages of this invention are to provide a grinding wheel dresser which is highly accurate, easily operated, compact, exceptionally rigid and strong, durable, of simple design and assembly, has a long in-service life and requires little, if any, maintenance and repair.

BRIEF DESCRIPTION OF THE DRAWINGS

These and other objects, features and advantages of this invention will be apparent from the following detailed description, the appended claims and the accompanying drawings in which:

DESCRIPTION OF THE PREFERRED EMBODIMENT

Figure 1:
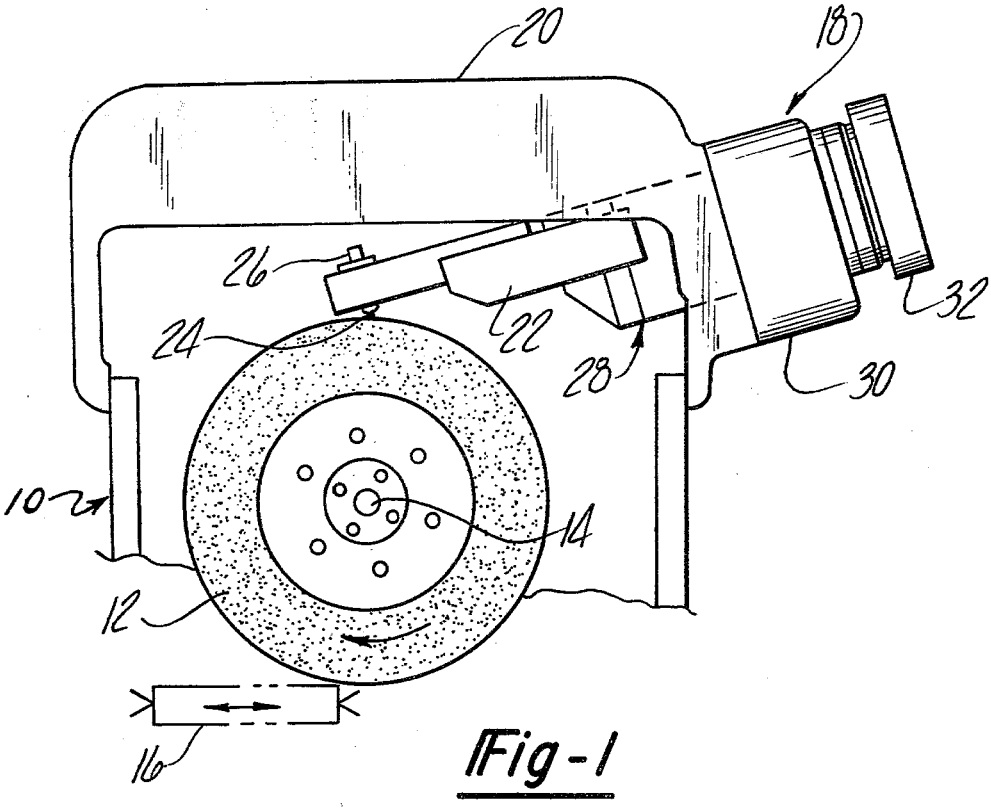
FIG. 1 is a fragmentary side view of a grinding machine having a grinding wheel dresser embodying this invention mounted thereon.

Referring in more detail to the drawings, FIG. 1 shows a grinding machine 10 with a grinding wheel 12 mounted on a spindle 14 which rotates the grinding wheel to remove material from a metal workpiece 16. A grinding wheel dresser 18 embodying this invention is mounted on a housing 20 of the grinding machine and has an arm 22 positioned to sweep a diamond tip 24 of a dressing tool 26 across the working face of grinding wheel 12 to dress the wheel by removing dull grains of abrasive and particles of metal and contaminants lodged between the grains of abrasive. To permit adjustment with respect to the working face of wheel 12 of the plane in which the diamond tip 24 is swept, arm 22 is pivotally carried by dresser 18 and has an arbor assembly 28 mounted for rotation in a body or housing 30 and connected to a dial knob 32 with angular graduations thereon.

Figure 3:
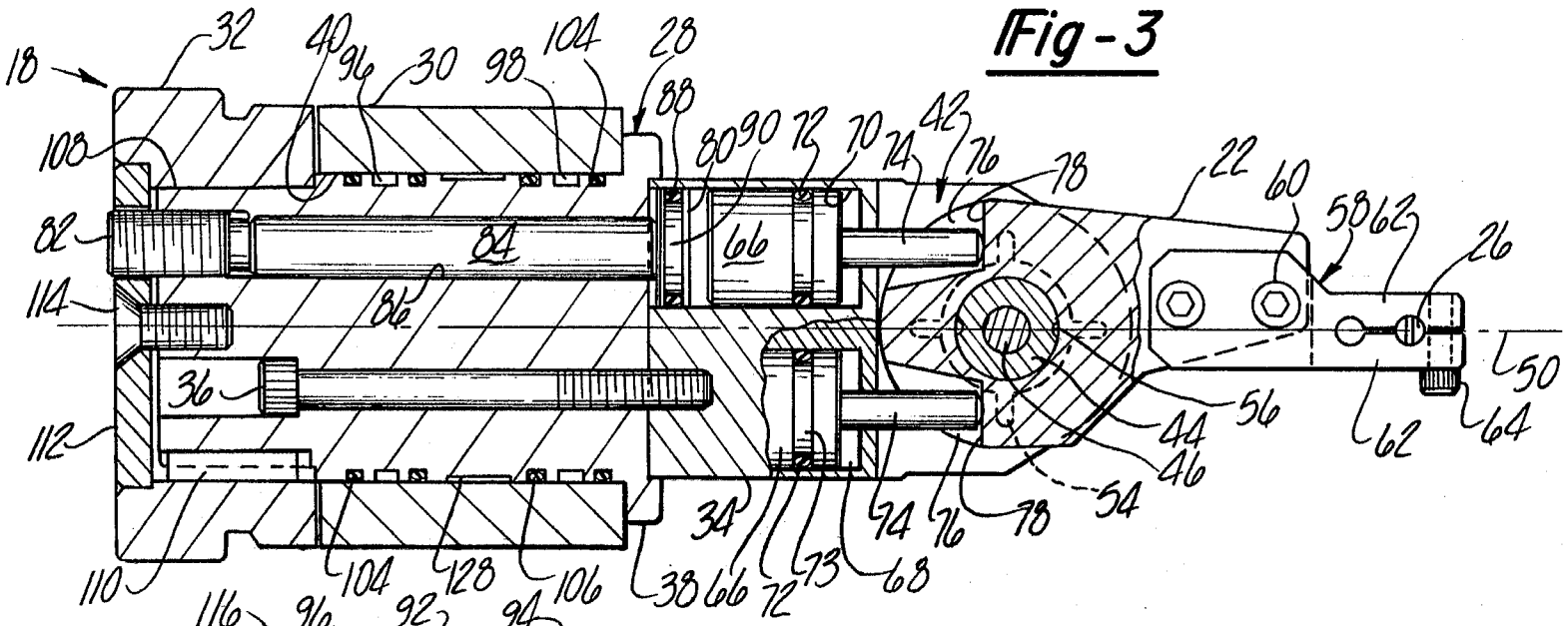
FIGS. 3 and 4 are top and side views, respectively, with portions broken away and shown in section of the grinding wheel dresser of FIG. 1.
Figure 4:
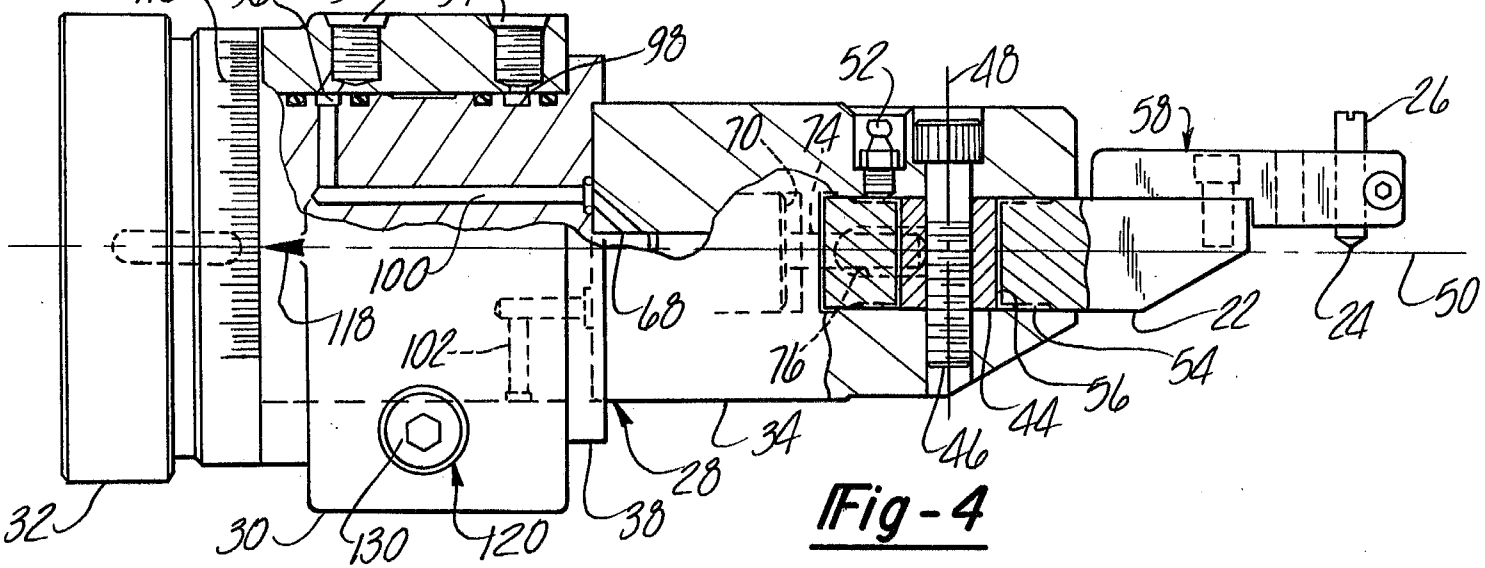

As shown in FIGS. 3 and 4, arbor assembly 28 has a cylinder block 34 secured by cap screws 36 to a journal block 38 received for rotation in a bore 40 in housing 30. One end of arm 22 is slidably received between the opposed faces of a slot 42 through the free end of cylinder block 34 and is pivotally mounted in the block by a bushing 44 and a cap screw 46. Preferably, the axis of rotation 48 of arm 22 is perpendicular to and intersects the axis of rotation 50 of arbor assembly 28. A lubricant such as grease is supplied to the pivotal mounting of arm 22 through a grease fitting 52 mounted on block 34 and communicating with passages defined by grooves 54 in arm 22 and grooves 56 in bushing 44. Diamond dressing tool 26 is mounted on arm 22 by a holder 58 secured to the arm by cap screws 60. The shank of dressing tool 26 is received and releasably retained between two fingers 62 drawn into firm clamping engagement with the shank by a cap screw 64.

In accordance with one feature of this invention, arm 22 is driven to sweep diamond tip 24 in an arcuate, although substantially straight-line, path generally transverse to the axis of rotation 50 of arbor assembly 28 by a pair of pistons 66 received in cylinders 68 and 70 in block 34. Each piston 66 has a fluid pressure seal 72 received in a groove 73 thereof and a plunger 74 which extends into a pocket 76 in arm 22 and bears on an abutment surface 78. The extent of the pivotal or arcuate movement of arm 22 and hence dressing tool 26 is controlled and can be varied by the axial location of discs 80 in cylinders 68 and 70 which provide stops or abutments limiting the travel of pistons 66. Each disc 80 can be axially displaced in its associated cylinder by rotating a self-locking set screw 82 threaded into the end of block 38 and bearing on one end of a pin 84 slidably received in a bore 86 in the block with its other end engagable with the disc. A seal is provided between each disc 80 and its associated cylinder by a fluid pressure seal 88 received in a groove 90 in the disc.

As shown in FIGS. 3 and 4, hydraulic fluid can be selectively admitted to (or exhausted from) cylinders 68 and 70 through respective ports 92 and 94 in housing 30, and interconnecting grooves 96 and 98 and passages 100 and 102 in arbor assembly 28 to act against the rear ends (left ends in FIGS. 3 and 4) of respective pistons 66. Fluid admitted to continuous grooves 96 and 98 is prevented from leaking between housing 30 and journal block 38 by fluid pressure seals 104 received in continuous grooves 106 adjacent both sides of grooves 96 and 98. Although hydraulic fluid is preferred, pistons 66 could be actuated pneumatically.

In accordance with another feature of this invention, the angular orientation of dressing tool 26 can be varied and adjusted by manually turning knob 32 which is slidably received on a reduced shank portion 108 of journal block 38 and coupled thereto by a key 110 for rotation therewith. Knob 32 is retained on journal 38 by a cover plate 112 received in a recess in the knob and secured to the journal by a screw 114. To facilitate selection of the desired angular orientation of dressing tool 26, knob 32 is provided with a scale 116 graduated in degrees and housing 30 has an appropriate reference marker 118.

Figure 2:
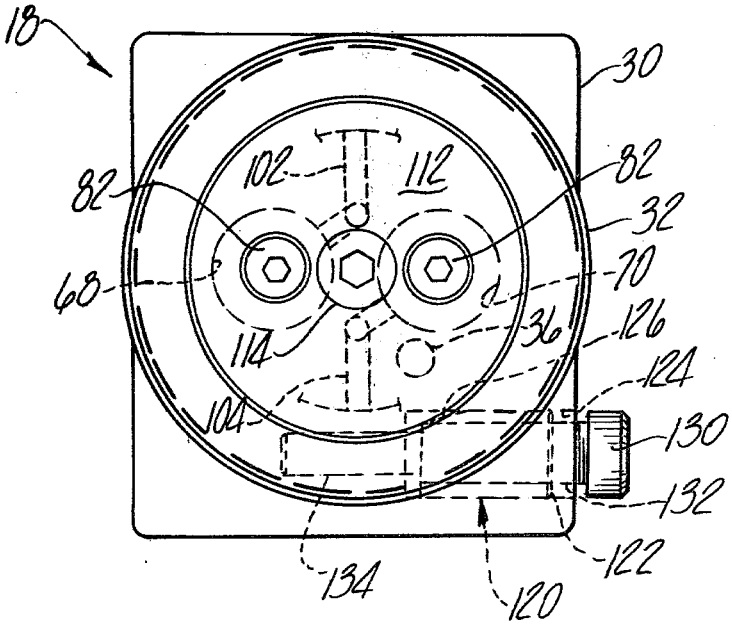
FIG. 2 is an end view of the grinding wheel dresser of FIG. 1.

Arbor assembly 28 can be releasably locked at any desired angular orientation by a wedge lock assembly 120. Lock assembly 120 has a bushing 122 (FIG. 2) received in a counterbore 124 in housing 30 and having a tapered surface 126 moved into and out of wedging engagement with a portion of the recessed surface 128 of journal 38 by a lock screw 130. Lock screw 130 has a first portion 132 threaded into bushing 122 and a second reduced diameter portion 134 threaded into housing 30 and having a pitch differing from that of the threads of the first portion 132.

Figure 5:
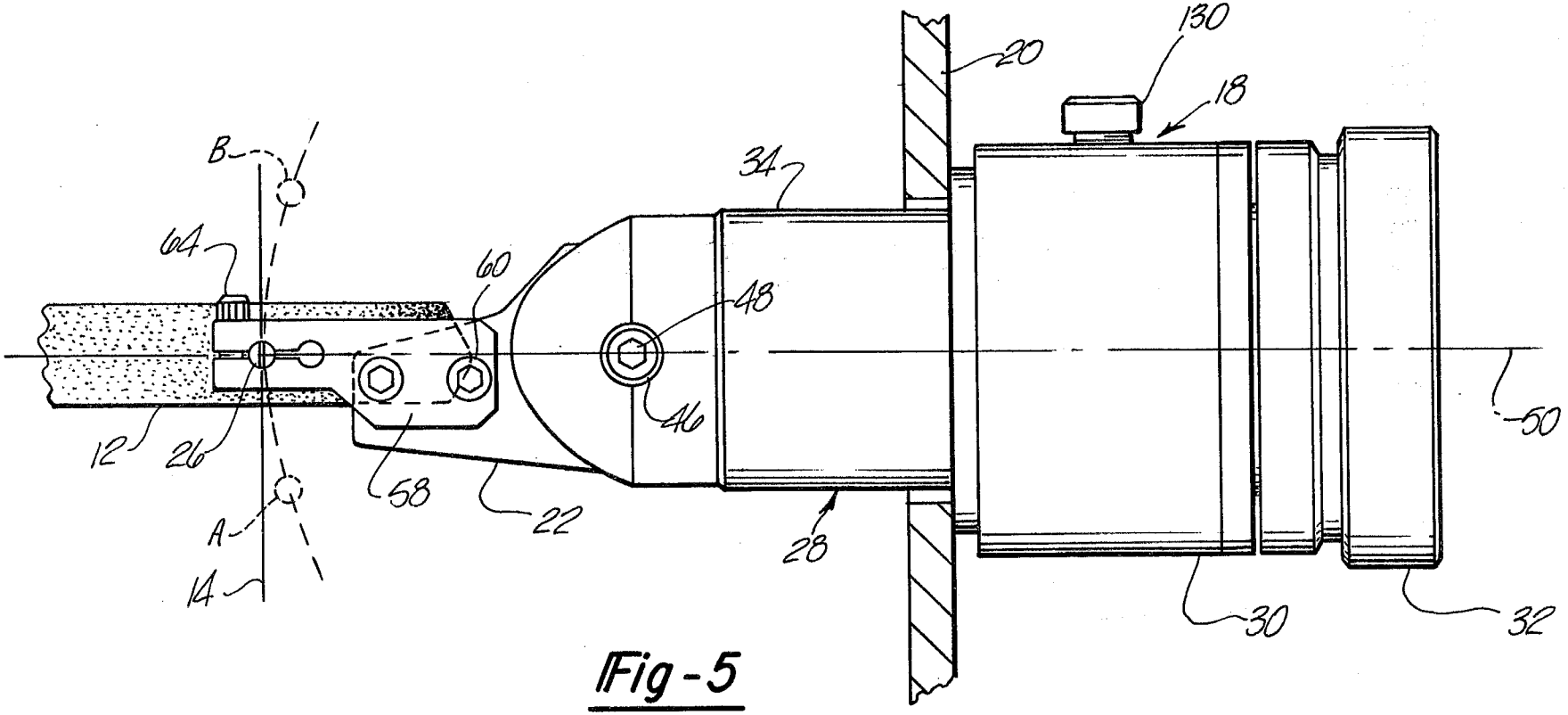
FIG. 5 is a top semi-schematic view of the grinding wheel dresser of FIG. 1 illustrating the movement of a dressing tool carried by the arm of the dresser relative to a grinding wheel of the grinding machine.

In using dresser 18 to dress the working surface of wheel 12 of machine 10, the desired length of travel of dressing tool 26 is set by turning screws 82. Dressing tool 26 is moved beyond the grinding wheel and to one end of its path of travel by admitting a fluid under pressure to one of the cylinders while exhausting the other cylinder. For example, arm 22 and can be rotated counterclockwise (as viewed in FIG. 3) so that tool 26 is in the position shown in phantom line at A in FIG. 5 by admitting hydraulic oil under pressure into cylinder 68 through port 92 and exhausing cylinder 70 through port 94. The extent of this counterclockwise rotation of arm 22 will be limited by the piston in cylinder 70 bearing on its associated stop disc 80 and pin 84. Then lock 120 is released, dial knob 32 is manually rotated to provide the desired angular orientation of the path of travel of the diamond tip 24 of the dresser tool 26, and lock 120 is actuated to secure the arbor assembly 28 in the desired angular orientation.

Housing 20 with dresser 18 thereon and grinding wheel 12 are moved generally vertically relative to each other through a conventional mechanism (not shown) so that when dressing tool 26 is swept across the working face of the wheel the desired amount of material will be removed to expose unused abrasive grains of the wheel. Thereafter, while wheel 12 is rotating, arm 22 is rotated to sweep the diamond tip 24 of dressing tool 26 across the working face of wheel 12 by admitting fluid under pressure to one of the cylinders while exhausting the other cylinder. For example, arm 22 can be rotated clockwise (as viewed in FIG. 3) so that tool 26 is in the position shown in phantom line at B in FIG. 5 by admitting hydraulic oil under pressure to cylinder 70 through port 94 and exhausting cylinder 68 through port 92. The extent of this clockwise rotation of arm 22 will be limited by the piston in cylinder 68 bearing against its associated stop disc 80 and pin 84. The direction of rotation and traverse of arm 32 may be reversed to sweep the dressing tool 26 back across the working face of the grinding wheel and return them to their original position by readmitting fluid under pressure to cylinder 68 and exhausting cylinder 70 through appropriate hydraulic valving (not shown).

The grinding wheel dresser of thisinvention is of relatively simple design and of rugged, durable, compact and rigid construction which provides a highly accurate and relatively maintenance-free dresser assembly having a long in-service life. A rotatable arbor assembly carrying both the arm and the fluid-actuated drive mechanism for sweeping a dressing tool across the working face of a grinding wheel provides a very versatile dressing mechanism which can be readily adjusted for removing material from grinding wheel working surfaces having various inclinations and contours.

I claim:

1. A grinding wheel dresser comprising a housing, an arbor carried by said housing for rotation with respect to said housing about an axis, an arm pivotly mounted on said arbor for rotation about an axis extending generally transverse to said axis of rotation of said arbor, having a free end extending beyond said arbor, and being constructed and arranged when rotated to move a dressing tool carried by said arm adjacent said free end thereof in a path generally transverse to said axis of rotation of said arbor, a pair of abutments on said arm located on opposite sides of said axis of rotation of said arm, a pair of cylinders each within said arbor, a fluid actuated piston slidably received in each of said cylinders, a plunger operatively associated with each piston and one of said abutments on said arm and constructed and arranged to rotate said arm with respect to said arbor when fluid is admitted under pressure to one of said cylinders so as to move the dressing tool carried by said arm along an arcuate path generally transverse to said axis of said arbor, said axis of rotation of said arm lying between and extending generally transverse to the paths of reciprocal movement of said pistons and plungers.

2. The grinding wheel dresser of claim 1 which also comprises an adjustable stop received within said arbor, accessible for adjustment from the exterior of said dresser, and constructed and arranged to limit and permit adjustment of the extent of the travel along its path of at least one of said pistons within its associated cylinder.

3. The grinding wheel dresser of claim 1 wherein said housing has a cylindrical bore therethrough and said arbor comprises a journal block having a generally cylindrical portion received in and extending through said bore of said housing, a dial knob secured to said journal block adjacent one end thereof, a separate cylinder block secured to said journal block adjacent the other end thereof, each of said cylinders comprises a blind bore opening into an end of said cylinder block adjacent said journal block, said cylinder block has a slot therein opening into an end of said cylinder block distal from said one end thereof and slidably receiving a portion of said arm therein, and means carried by said cylinder block and constructed and arranged to pivotly mount said arm within said slot of said cylinder block.

4. The grinding wheel dresser of claim 3 which also comprises a disc slidably received in one of said cylinders, a seal carried by said disc and providing a fluid pressure seal between said disc and its associated cylinder, and a stop member carried by said journal block and adjustable from the exterior of said dresser to extend into the bore of the cylinder associated with said disc to position within and limit movement in at least one direction of said disc within said associated cylinder so as to limit and permit adjustment of the extend of travel in one direction of the piston received in said associated cylinder.

5. A grinding wheel dresser comprising a housing having a generally cylindrical bore therethrough, an arbor having a cylindrical portion slidably received in said bore for rotation of said arbor with respect to said housing about an axis of said bore and a portion projecting generally axially beyond said bore and having a slot therein opening generally axially outwardly, an arm carried by said arbor and having a first portion received in said slot and a second portion projecting generally axially beyond said slot and constructed and arranged to mount a dressing tool thereon, means on said arbor constructed and arranged to mount said arm in said slot for rotation with respect to said arbor about an axis generally transverse to said axis of said bore, said arm having a pair of abutments thereon located on opposite sides of said axis of rotation of said arm, spaced apart first and second cylinders each disposed in said arbor, a fluid actuated piston received in each of said cylinders and having a plunger extending through its associated cylinder and constructed and arranged to bear on one of said abutments on said arm such that when a fluid is admitted under pressure to move the piston in one of said cylinders in at least one direction along a path generally transverse to the axis of rotation of said arm said arm is caused to move the dressing tool in at least one direction in a generally arcuate path, and said axis of rotation of said arm lies between said paths along which said pistons and plungers are displaced which paths are spaced apart from each other.

* * * * *

UNITED STATES PATENT AND TRADEMARK OFFICE

CERTIFICATE OF CORRECTION

PATENT NO. : 4,202,317

DATED : May 13, 1980

INVENTOR(S) : Anthony Kushigian

It is certified that error appears in the above-identified patent and that said Letters Patent are hereby corrected as shown below:

In column 3, line 24, delete "and".

In column 3, line 61, delete "thisinvention" and insert -- this invention --.

Signed and Sealed this

*Twenty-first* Day of *April 1981*

[SEAL]

*Attest:*

RENE D. TEGTMEYER

*Attesting Officer* *Acting Commissioner of Patents and Trademarl*